US008827477B2

(12) United States Patent
Doering et al.

(10) Patent No.: US 8,827,477 B2
(45) Date of Patent: Sep. 9, 2014

(54) REFRIGERATOR APPLIANCE

(71) Applicant: General Electric Company, Schenectady, NY (US)

(72) Inventors: Tyler James Doering, Louisville, KY (US); Justin Tyler Brown, Louisville, KY (US); Joseph Thomas Waugh, Louisville, KY (US)

(73) Assignee: General Electric Company, Schenectady, NY (US)

( * ) Notice: Subject to any disclaimer, the term of this patent is extended or adjusted under 35 U.S.C. 154(b) by 15 days.

(21) Appl. No.: 13/711,883

(22) Filed: Dec. 12, 2012

(65) Prior Publication Data

US 2014/0160730 A1 Jun. 12, 2014

(51) Int. Cl.

| | |
|---|---|
| ***F25D 23/00*** | (2006.01) |
| ***F25D 27/00*** | (2006.01) |
| ***F24C 15/00*** | (2006.01) |
| *F21W 131/305* | (2006.01) |

(52) U.S. Cl.

CPC ..... *F25D 27/00* (2013.01); *F21W 2131/305* (2013.01); *F24C 15/008* (2013.01)

USPC ..... 362/92

(58) Field of Classification Search

CPC ..... F24C 15/008; F21W 2131/305; F21Y 2101/02

USPC ..... 362/92

See application file for complete search history.

(56) References Cited

U.S. PATENT DOCUMENTS

| | | | | |
|---|---|---|---|---|
| 7,364,322 | B2 * | 4/2008 | Oppor et al. | 362/247 |
| 8,141,748 | B2 | 3/2012 | Kim | |
| 8,590,745 | B2 * | 11/2013 | Filho et al. | 222/113 |
| 8,613,205 | B2 * | 12/2013 | Flores et al. | 62/264 |
| 2011/0174008 | A1 * | 7/2011 | Kim | 62/264 |
| 2012/0031124 | A1 * | 2/2012 | McDaniel | 62/125 |

* cited by examiner

*Primary Examiner* — Anabel Ton

(74) *Attorney, Agent, or Firm* — Dority & Manning, P.A.

(57) ABSTRACT

A refrigerator appliance is provided. The refrigerator appliance includes a printed circuit board positioned within a door of the refrigerator appliance above a dispenser recess of the refrigerator appliance. An orthogonal light emitting device is mounted to the printed circuit board and is configured for directing light into the dispenser recess.

19 Claims, 5 Drawing Sheets

REFRIGERATOR APPLIANCE

FIELD OF THE INVENTION

The present subject matter relates generally to refrigerator appliances.

BACKGROUND OF THE INVENTION

Certain refrigerator appliances include a dispenser that permits a user to access ice stored within the refrigerator appliance without opening the refrigerator appliance's doors. Such refrigerator appliances can include a paddle or other actuator mounted within a dispenser recess. The user can insert a cup into the dispenser recess or press it against the actuator in order to initiate a flow of ice or water into the cup.

To assist the user with operating the dispenser, certain dispensers include a light source mounted within the dispenser recess. The light source can direct light into the dispenser recess when the user inserts a cup into the dispenser recess and/or presses the cup against the actuator. Light from the light source can assist the user with locating the actuator or viewing the level of water or ice within the cup.

Certain refrigerator appliances utilize a light emitting diode (LED) mounted to a control panel positioned above the dispenser recess as the light source. In particular, such refrigerator appliances generally utilize a forward firing LED as the light source. When utilizing the forward firing LED, the control panel generally includes two separate printed circuit boards. The first printed circuit board can be vertically oriented and include buttons mounted thereto for permitting the user to input control selections, such as selecting between water and ice or whole ice and crushed ice. The second printed circuit board can be horizontally oriented, and the forward firing LED can be mounted thereto in order to direct light downwardly into the dispenser recess.

Utilizing forward firing LEDs can have certain drawbacks. In particular, manufacturing two separate printed circuit boards can be expensive. Thus, having two printed circuit boards can add to or increase the overall cost of the refrigerator appliance. Further, utilizing multiple orthogonally oriented printed circuit boards can consume valuable space within the dispenser.

Accordingly, a refrigerator appliance with features for directing light into a dispenser recess of the refrigerator appliance would be useful. In particular, a refrigerator appliance with features for directing light into a dispenser recess of the refrigerator appliance without utilizing multiple printed circuit boards would be useful.

BRIEF DESCRIPTION OF THE INVENTION

The present subject matter provides a refrigerator appliance. The refrigerator appliance includes a printed circuit board positioned within a door of the refrigerator appliance above a dispenser recess of the refrigerator appliance. An orthogonal light emitting device is mounted to the printed circuit board and is configured for directing light into the dispenser recess. Additional aspects and advantages of the invention will be set forth in part in the following description, or may be apparent from the description, or may be learned through practice of the invention.

In a first exemplary embodiment, a refrigerator appliance is provided. The refrigerator appliance defines a vertical direction and a transverse direction. The refrigerator appliance includes a cabinet that defines a chilled chamber for receipt of food items for storage. A door is rotatably mounted to the cabinet for permitting selective access to the chilled chamber of the cabinet. The door defines a dispenser recess. A printed circuit board is positioned within the door. The printed circuit board is positioned adjacent the dispenser recess of the door. An orthogonal light emitting device is mounted to the printed circuit board and is configured for directing light into the dispenser recess of the door.

In a second exemplary embodiment, a refrigerator appliance is provided. The refrigerator appliance defines a vertical direction and a transverse direction. The refrigerator appliance includes a cabinet that defines a chilled chamber for receipt of food items for storage. A door is rotatably mounted to the cabinet for permitting selective access to the chilled chamber of the cabinet. A dispenser is mounted to the door. The dispenser defines a dispenser recess and is configured for directing a flow of ice or water into the dispenser recess of the dispenser. A printed circuit board is positioned above the dispenser recess of the dispenser along the vertical direction. A side-firing light emitting diode (LED) is mounted to the printed circuit board and is configured for directing light downwardly along the vertical direction into the dispenser recess of the dispenser.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
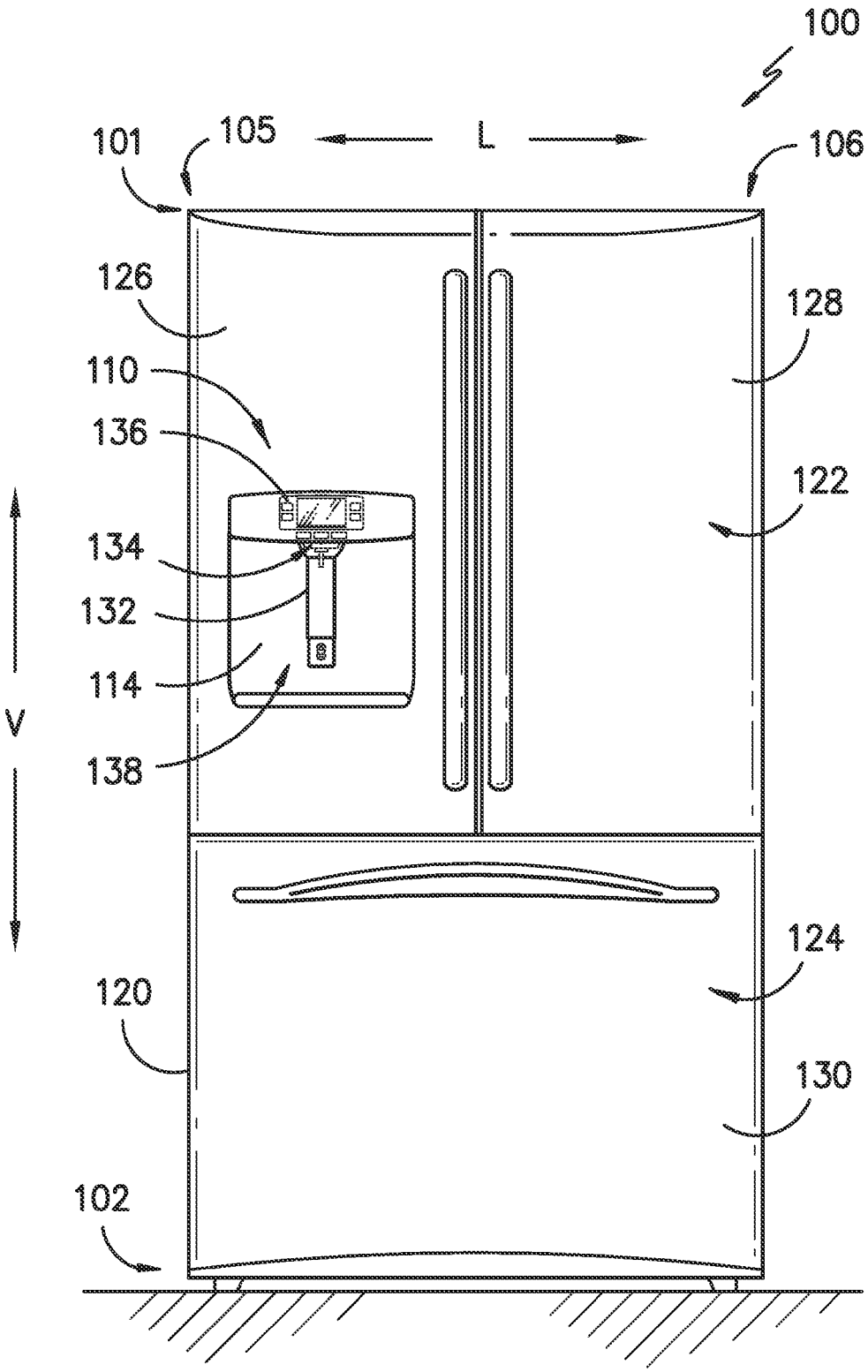
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
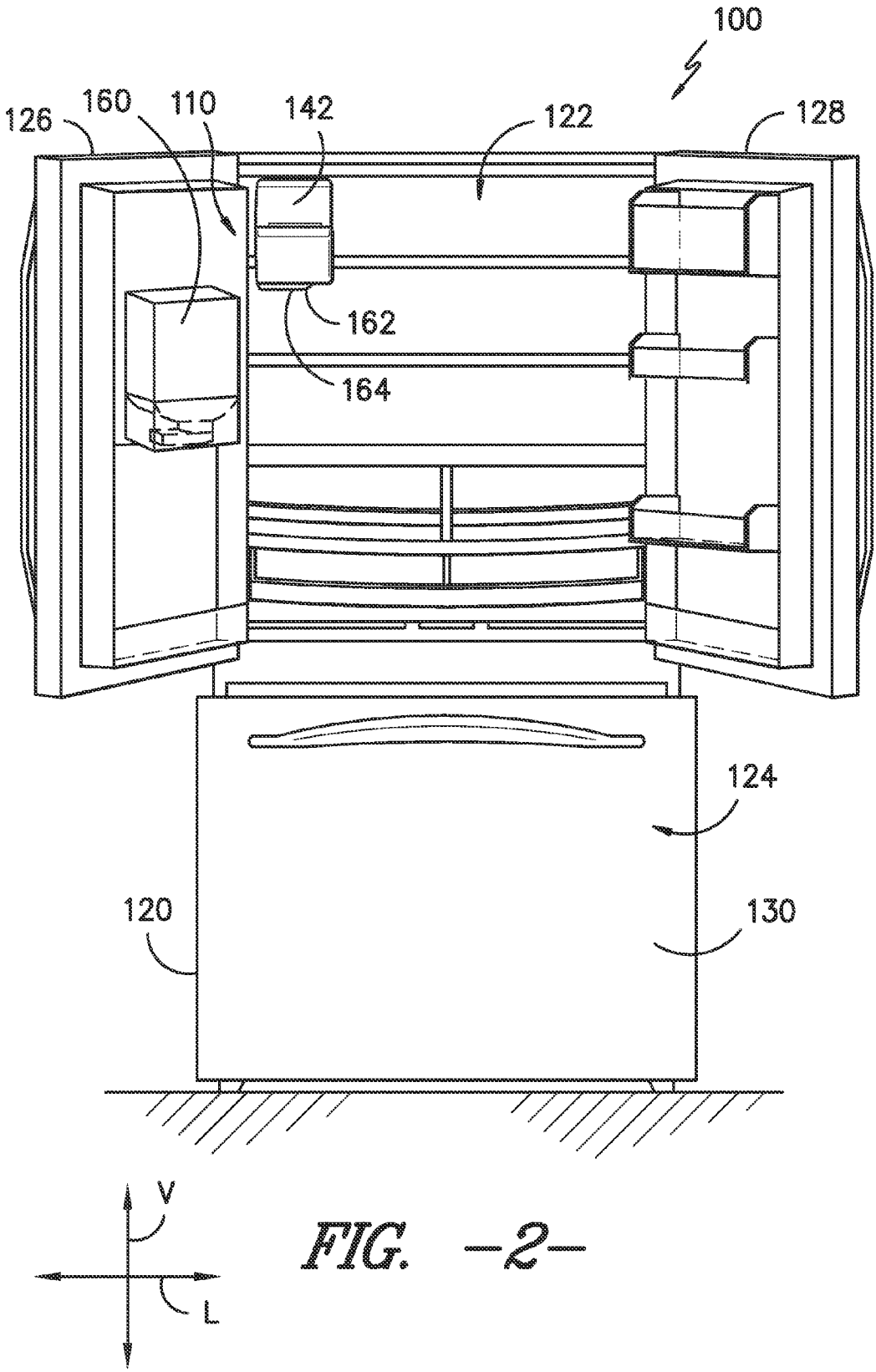
FIG. 2 provides a front, elevation view of the refrigerator appliance of FIG. 1 with refrigerator doors of the refrigerator appliance shown in an open position to reveal a fresh food chamber of the refrigerator appliance.

FIG. 1 provides a front, elevation view of a refrigerator appliance 100 according to an exemplary embodiment of the present subject matter. FIG. 2 provides a front, elevation view of refrigerator appliance 100 with refrigerator doors 128 of refrigerator appliance 100 shown in an open position to reveal a fresh food chamber 122 of refrigerator appliance 100. Refrigerator appliance 100 defines a vertical direction V, a transverse direction T (FIG. 5), and a lateral direction L. The vertical direction V, transverse direction T, and lateral direction L are mutually perpendicular and form an orthogonal direction system. Refrigerator appliance 100 extends between an upper portion 101 and a lower portion 102 along the vertical direction V. Refrigerator appliance 100 also extends between a first side portion 105 and a second side portion 106 along the lateral direction L.

Refrigerator appliance 100 includes a cabinet or housing 120 that defines chilled chambers for receipt of food items for storage. In particular, refrigerator appliance 100 defines fresh food chamber 122 at upper portion 101 of refrigerator appliance 100 and a freezer chamber 124 arranged below fresh food chamber 122 on the vertical direction V, e.g., at lower portion 102 of refrigerator appliance 100. As such, refrigerator appliance 100 is generally referred to as a bottom mount refrigerator appliance. However, using the teachings disclosed herein, one of skill in the art will understand that the present subject matter may be used with other types of refrigerator appliances (e.g., side-by-side style or top mount style) or a freezer appliance as well. Consequently, the description set forth herein is for illustrative purposes only and is not intended to limit the present subject matter in any aspect.

Refrigerator doors 126 and 128 are rotatably hinged to an edge of housing 120 for accessing fresh food compartment 122. A freezer door 130 is arranged below refrigerator doors 126 and 128 for accessing freezer chamber 124. Freezer door 130 is coupled to a freezer drawer (not shown) slidably mounted within freezer chamber 124.

Refrigerator appliance 100 also includes a dispensing assembly 110 for dispensing water and/or ice. Dispensing assembly 110 includes a dispenser 114 positioned on or mounted to an exterior portion of refrigerator appliance 100, e.g., on refrigerator door 126. Dispenser 114 includes a discharging outlet 134 for accessing ice and water. A sensor 132, such as an ultrasonic sensor, is mounted below discharging outlet 134 for operating dispenser 114. In alternative exemplary embodiments, any suitable actuator may be used to operate dispenser 114. For example, dispenser 114 can include a paddle or button rather than sensor 132. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 134 and sensor 132 are an external part of dispenser 114 and are mounted in a dispenser recess 138 defined in an outside surface of refrigerator door 126. Dispenser recess 138 is positioned at a predetermined elevation convenient for a user to access ice or water and enabling the user to access ice without the need to bend-over and without the need to access freezer chamber 124. In the exemplary embodiment, dispenser recess 138 is positioned at a level that approximates the chest level of a user.

Turning now to FIG. 2, certain components of dispensing assembly 110 are illustrated. Dispensing assembly 110 includes an insulated housing 142 mounted within fresh food chamber 122. Due to the insulation which encloses insulated housing 142, the temperature within insulated housing 142 can be maintained at levels different from the ambient temperature in the surrounding fresh food chamber 122.

Insulated housing 142 is constructed and arranged to operate at a temperature that facilitates producing and storing ice. More particularly, insulated housing 142 contains an ice maker for creating ice and feeding the same to a container 160 that is mounted on refrigerator door 126. As illustrated in FIG. 2, container 160 is placed at a vertical position on refrigerator door 126 that will allow for the receipt of ice from a discharge opening 162 located along a bottom edge 164 of insulated housing 142. As refrigerator door 126 is closed or opened, container 160 is moved in and out of position under insulated housing 142.

Operation of the refrigerator appliance 100 can be regulated by a controller (not shown) that is operatively coupled to user interface panel 136 and/or sensor 132. Panel 136 provides selections for user manipulation of the operation of refrigerator appliance 100 such as e.g., selections between whole or crushed ice, chilled water, and/or other options as well. In response to user manipulation of the user interface panel 136, the controller operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator appliance 100. In the illustrated embodiment, the controller may be located within the control panel area of refrigerator door 126. In such an embodiment, input/output ("I/O") signals may be routed between the controller and various operational components of refrigerator appliance 100. The user interface 136 may be in communication with the controller via one or more signal lines or shared communication busses.

Figure 3:
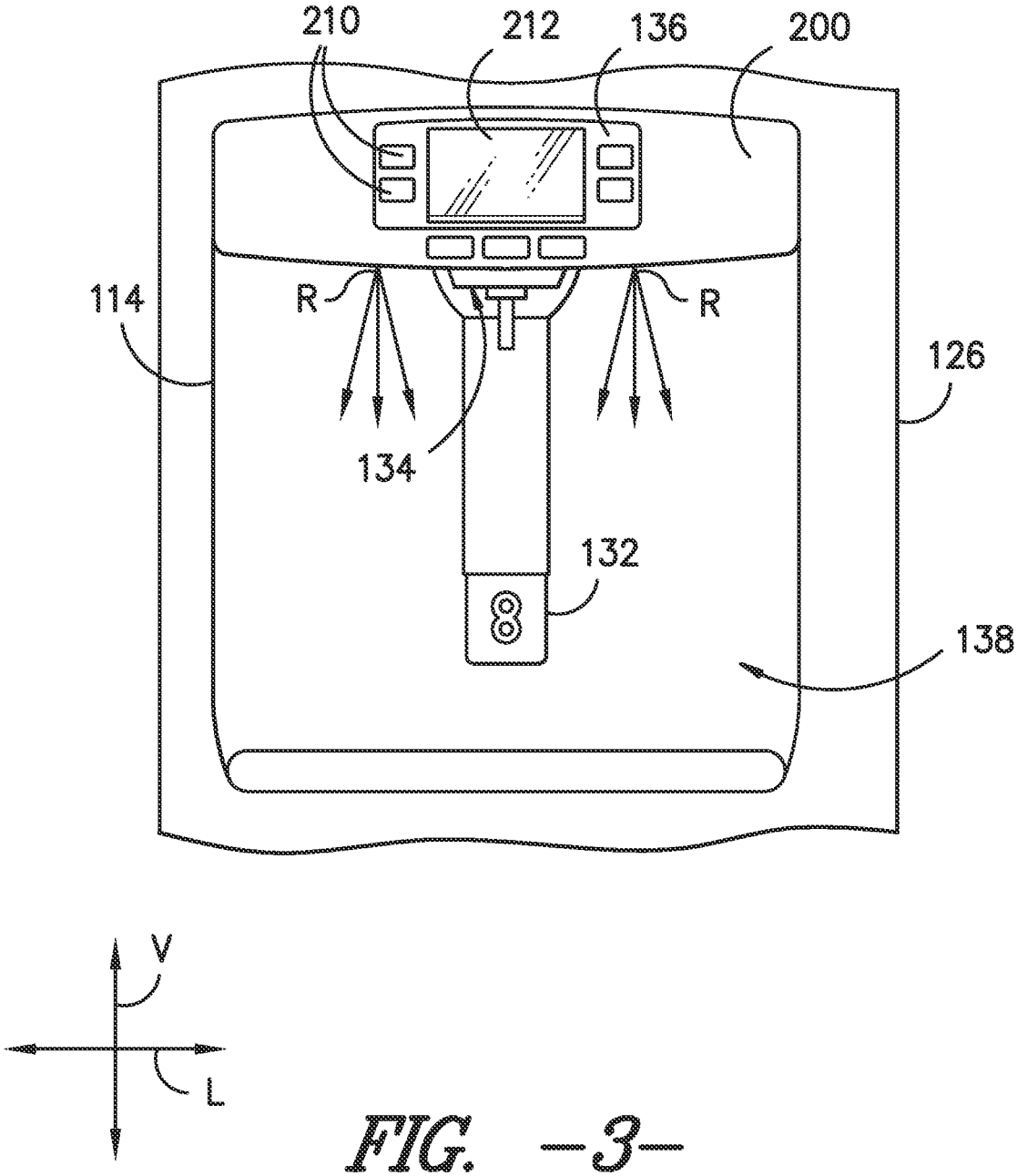
FIG. 3 provides a partial front, elevation view of the refrigerator appliance of FIG. 1 illustrating a dispenser according to an exemplary embodiment of the present subject matter.

FIG. 3 provides a partial front, elevation view of dispenser 114 of refrigerator appliance 100. As may be seen in FIG. 3, dispenser 114 includes a mounting bracket 200. Various components of user interface panel 136 are mounted to refrigerator appliance 100 with mounting bracket 200. In particular, a plurality of input components 210 and a display 212 are mounted at dispenser 114 with mounting bracket 200. Plurality of input components 210 may include various input components, such as one or more of a variety of electrical, mechanical or electro-mechanical input devices including rotary dials, push buttons, and touch pads. Display 212, such as a digital or analog display device, can provide operational feedback to a user.

As may be seen in FIG. 3, refrigerator appliance 100 includes features for directing light (shown with arrows R) into dispenser recess 138. In particular, refrigerator appliance 100 include features for directing light downwardly along the vertical direction V, e.g., from mounting bracket 200, into dispenser recess 138. Such features are discussed in greater detail below.

Light R can assist a user with directing a cup or container into dispenser recess 138 or towards sensor 132. Further, light R can assist a user with viewing the container during filling of the container with ice and/or water from outlet 134. As an example, the controller (not shown) of refrigerator appliance 100 can activate light R when a container is inserted into dispenser recess 138 and/or when the container is moved towards sensor 132.

Figure 4:
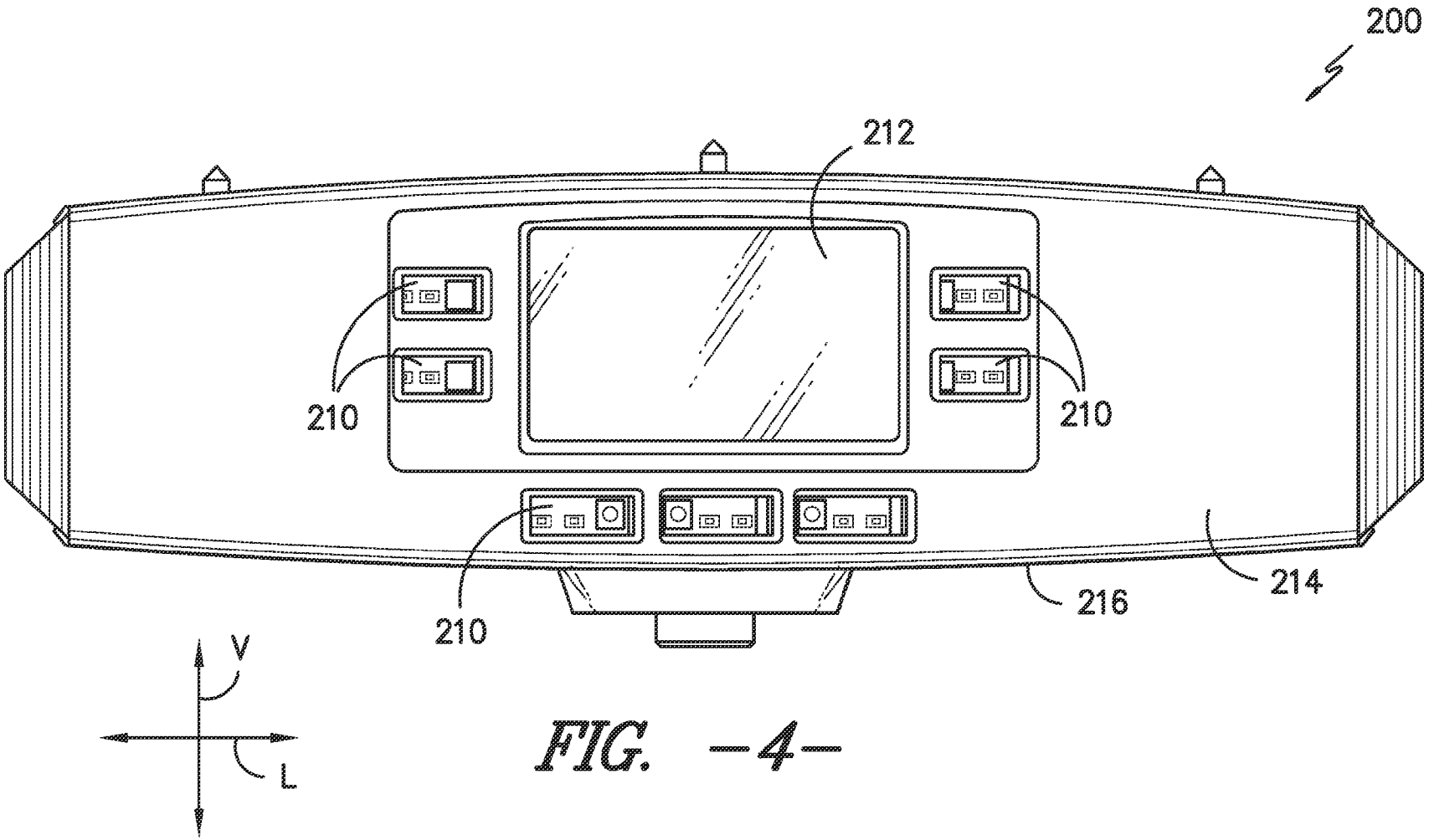
FIG. 4 provides a front, elevation view of a mounting bracket of the dispenser of FIG. 3 removed from the refrigerator appliance.
Figure 5:
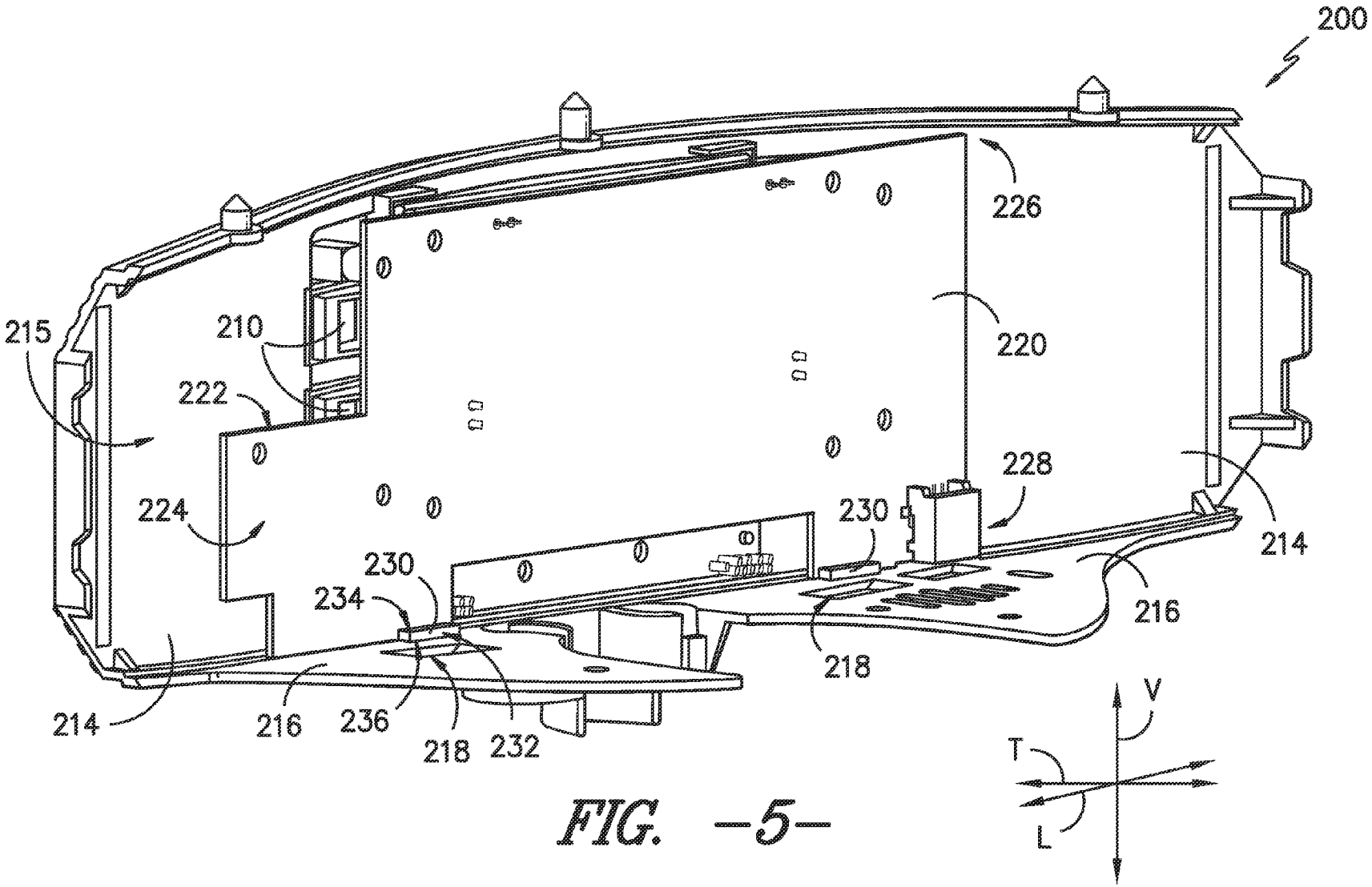
FIG. 5 provides a front, perspective view of the mounting bracket of FIG. 4 and a printed circuit board of the dispenser.

FIG. 4 provides a front, elevation view of mounting bracket 200 removed from refrigerator appliance 100. FIG. 5 provides a front, perspective view of mounting bracket 200. Mounting bracket 200 includes a front wall 214 and a bottom wall 216. Front wall 214 and back wall 216 are perpendicularly oriented to each other, e.g., in a plane that is perpendicular to the lateral direction L. As may be seen in FIG. 5, refrigerator appliance 100 includes a printed circuit board 220 attached to mounting bracket 200. In particular, printed circuit board 220 can be mounted at a rear surface 215 of front wall 214, e.g., above bottom wall 216 along the vertical direction V. Thus, printed circuit board 220 is positioned within refrigerator door 126, e.g., above dispenser recess 138 along the vertical direction V. In alternative exemplary embodiments, printed circuit board 220 can positioned at any suitable location within refrigerator door 126, e.g., below dispenser recess 138 along the vertical direction V or beside or adjacent dispenser recess 138 along the lateral direction L.

Printed circuit board 220 extends between a top portion 226 and a bottom portion 228 along the vertical direction V. Thus, printed circuit board 220 is vertically oriented. In particular, bottom portion 228 of printed circuit board 220 is positioned adjacent bottom wall 216 of mounting bracket 200, and top portion 226 of printed circuit board 220 is spaced apart from bottom wall 216 of mounting bracket 200, e.g., such that printed circuit board 220 is substantially vertical in a plane that is perpendicular to the lateral direction L.

Printed circuit board 220 also has a front surface 222 and a back surface 224. Back surface 224 is positioned opposite front surface 222 on printed circuit board 220, e.g., such that front and back surfaces 222 and 224 are spaced apart from each other along the transverse direction T. Front surface 222 of printed circuit board 220 faces mounting bracket 200, e.g., rear surface 215 of front wall 214. Conversely, back surface 224 of printed circuit board 220 faces away from mounting bracket 200, e.g., rear surface 215 of front wall 214, or faces interior of refrigerator door 126.

Printed circuit board 220 can form (at least a portion of) the controller of refrigerator appliance 100. Thus, input components 210 are positioned on or mounted to front surface 222 of printed circuit board 220. Similarly, display 212 is positioned on or mounted to front surface 222 of printed circuit board 220. In such positions, input components 210 and display 212 are positioned adjacent mounting bracket 200, e.g., rear surface 215 of front wall 214, such that a user can utilize input components 210 and display 212.

As discussed above, refrigerator appliance 100 includes features for directing light R into dispenser recess 138 (FIG. 3). In particular, refrigerator appliance 100 includes orthogonal light emitting devices positioned on or mounted to printed circuit board 220 and configured for directing light R into dispenser recess 138. In the exemplary embodiment shown in FIG. 5, the orthogonal light emitting devices are shown as side-firing light emitting diodes (LEDs) 230. However, in alternative exemplary embodiments, the orthogonal light emitting devices can be any suitable device for emitting light R, e.g., such that light R is substantially perpendicular to a line that is normal to front or back surfaces 222 and 224 of printed circuit board 220. For example, the orthogonal light emitting devices can be top-view LEDs or reverse-mount LEDs with light redirecting devices, such as reflectors, lenses, or fiber optic cables, that redirect light R, e.g., such that light R is substantially perpendicular to a line that is normal to front or back surfaces 222 and 224 of printed circuit board 220.

As shown in FIG. 5, side-firing LEDs 230 are positioned on or mounted to printed circuit board 220 and configured for directing light R into dispenser recess 138. In particular, side-firing LEDs 230 is positioned or configured for directing light downwardly along the vertical direction V into dispenser recess 138. Light R emitted by side-firing LEDs 230 can be substantially parallel to front surface 222 and/or back surface 224, e.g., rather than substantially perpendicular to front and back surfaces 222 and 224 as with front-firing LEDs. To permit light R emitted by side-firing LEDs 230 to enter dispenser recess 138, mounting bracket 200, e.g., bottom wall 216, defines openings 218 that are aligned with side-firing LEDs 230 along the vertical direction V. Light R can pass through mounting bracket 200 through openings 218 and enter dispenser recess 138.

Side-firing LEDs 230 are positioned at bottom portion 228 of printed circuit board 220, e.g., adjacent openings 218. In the exemplary embodiment shown in FIG. 5, side-firing LEDs 230 are positioned on or mounted to back surface 224 of printed circuit board 220. In alternative exemplary embodiments, side-firing LEDs 230 can be positioned on or mounted to front surface 222 of printed circuit board 220.

Side-firing LEDs 230 extend between a proximal end portion 234 and a distal end portion 232, e.g., along the transverse direction T. Proximal end portion 234 is positioned at or mounted to printed circuit board 220. Conversely, distal end portion 232 is spaced apart from printed circuit board 220, e.g., along the transverse direction T. Thus, side-firing LEDs 230 are mounted to and extends away from printed circuit board 220, e.g., front or back surfaces 222 or 224 of printed circuit board 220. Side-firing LEDs 230 also have a bottom surface 236 that extends between proximal end portion 234 and distal end portion 232 of side-firing LEDs 230, e.g., along the transverse direction T. Side-firing LEDs 230 are configured for emitting light R downwardly along the vertical direction V from bottom surface 236 of side-firing LEDs 230, e.g., into disperser recess 138.

By utilizing side-firing LEDs 230, light R can be directed into dispenser recess 138 despite printed circuit board 220 being vertically oriented. Further, input components 210 and/or display 212 and side-firing LEDs 230 can be mounted to printed circuit board 220 rather than requiring multiple printed circuit boards, e.g., one printed circuit board for input components 210 and display 212 and another printed circuit board for an LED.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, the refrigerator appliance defining a vertical direction and a transverse direction, the refrigerator appliance comprising:

a cabinet that defines a chilled chamber for receipt of food items for storage;

a door rotatably mounted to said cabinet for permitting selective access to the chilled chamber of said cabinet, said door defining a dispenser recess;

a printed circuit board positioned within said door, said printed circuit board positioned adjacent the dispenser recess of said door; and an orthogonal light emitting device mounted to said printed circuit board and configured for directing light into the dispenser recess of said door, wherein said orthogonal light emitting device comprises a side-firing light emitting diode (LED), a top-view LED with a light redirecting device, or a reverse-mount LED with a light redirecting device.

2. The refrigerator appliance of claim 1, wherein said printed circuit board extends between a top portion and a bottom portion along the vertical direction, said orthogonal light emitting device positioned at the bottom portion of said printed circuit board.

3. The refrigerator appliance of claim 1, wherein said printed circuit board has a front surface and a back surface, the back surface positioned opposite the front surface on said printed circuit board, orthogonal light emitting device positioned on the back surface of said printed circuit board.

4. The refrigerator appliance of claim 3, further comprising a plurality of input components positioned on the front surface of said printed circuit board.

5. The refrigerator appliance of claim 3, further comprising a display positioned on the front surface of said printed circuit board.

6. The refrigerator appliance of claim 1, wherein said printed circuit board has a front surface and a back surface, the back surface positioned opposite the front surface on said printed circuit board, said orthogonal light emitting device positioned on the front surface of said printed circuit board.

7. The refrigerator appliance of claim 1, wherein said printed circuit hoard has a front surface and a back surface, the hack surface positioned opposite the front surface on said printed circuit board, said orthogonal light emitting device configured for emitting light that is substantially parallel to the front or the back surface of said printed circuit board.

8. The refrigerator appliance of claim 1, further comprising a mounting bracket positioned on said door at the dispenser recess of said door, said printed circuit board attached to said mounting bracket.

9. The refrigerator appliance of claim 8, wherein said printed circuit board has a front surface and a back surface, the front surface facing said mounting bracket, said orthogonal light emitting device positioned on the back surface of said printed circuit board.

10. A refrigerator appliance, the refrigerator appliance defining a vertical direction and a transverse direction, the refrigerator appliance comprising:

a cabinet that defines a chilled chamber for receipt of food items for storage;

a door rotatably mounted to said cabinet for permitting selective access to the chilled chamber of said cabinet;

a dispenser mounted to said door, said dispenser defining a dispenser recess, said dispenser configured for directing a flow of ice or water into the dispenser recess of said dispenser;

a printed circuit board positioned above the dispenser recess of said dispenser along the vertical direction; and a side-firing light emitting diode (LED) mounted to said printed circuit board and configured for directing light downwardly along the vertical direction into the dispenser recess of said dispenser.

11. The refrigerator appliance of claim 10, wherein said printed circuit board extends between a top portion and a bottom portion along the vertical direction, said side-firing LED positioned at the bottom portion of said printed circuit board.

12. The refrigerator appliance of claim 10, wherein said printed circuit board has a front surface and a back surface, the back surface positioned opposite the front surface on said printed circuit board, said side-firing LED positioned on the back surface of said printed circuit board.

13. The refrigerator appliance of claim 12, further comprising a plurality of input components positioned on the front surface of said printed circuit board.

14. The refrigerator appliance of claim 12, further comprising a display positioned on the front surface of said printed circuit board.

15. The refrigerator appliance of claim 10, wherein said printed circuit board has a front surface and a back surface, the back surface positioned opposite the front surface on said printed circuit board, said side-firing LED positioned on the front surface of said printed circuit board.

16. The refrigerator appliance of claim 10, wherein said side-firing LED extends between a proximal end portion and a distal end portion along the transverse direction, the proximal end portion positioned at the printed circuit board, the distal end portion spaced apart from said printed circuit board along the transverse direction, said side-firing LED also having a bottom surface that extends between the proximal end portion and the distal end portion along the transverse direction, said side-firing LED configured for emitting light downwardly along the vertical direction from the bottom surface of said side-firing LED.

17. The refrigerator appliance of claim 10, further comprising a mounting bracket positioned on said door at the dispenser recess of said dispenser, said printed circuit board attached to said mounting bracket.

18. The refrigerator appliance of claim 17, wherein said printed circuit board has a front surface and a back surface, the front surface facing said mounting bracket, said side-firing LED positioned on the back surface of said printed circuit board.

19. The refrigerator appliance of claim 17, wherein said mounting bracket defines an opening aligned with said side-firing LED along the vertical direction.

* * * * *